US005507339A

United States Patent [19]

Holbrook

[11] Patent Number: 5,507,339

[45] Date of Patent: Apr. 16, 1996

[54] REINFORCED HYDRAULICALLY EXPANDED COIL

[75] Inventor: Richard L. Holbrook, Louisville, Ohio

[73] Assignee: The Babcock & Wilcox Company, New Orleans, La.

[21] Appl. No.: 60,686

[22] Filed: May 12, 1993

Related U.S. Application Data

[63] Continuation-in-part of Ser. No. 872,488, Apr. 22, 1992, abandoned.

[51] Int. Cl.[6] ..... F28F 7/00

[52] U.S. Cl. ..... 165/81; 165/82; 165/134.1; 165/169; 165/906

[58] Field of Search ..... 165/168, 170, 165/169, 156, 81, 82, 134.1, 906; 29/890.039, 890.042, 890.91

[56] References Cited

U.S. PATENT DOCUMENTS

| | | | |
|---|---|---|---|
| 1,804,624 | 5/1931 | King | 165/156 |
| 1,990,738 | 2/1935 | La Porte | 165/156 |
| 2,049,708 | 8/1936 | Lieb | 165/169 |
| 2,835,961 | 5/1958 | Neel et al. | 29/890.042 |
| 2,995,807 | 8/1961 | Gibbs | 165/169 |
| 2,999,308 | 9/1961 | Pauls | 165/164 |
| 3,335,789 | 8/1967 | Raskin | 165/169 |
| 3,831,246 | 8/1974 | Morris | 29/890.042 |
| 4,282,861 | 8/1981 | Roark | 165/169 |
| 4,295,255 | 10/1981 | Weber | 29/890.037 |
| 5,070,607 | 12/1991 | Boardman et al. | 29/890.042 |
| 5,138,765 | 8/1992 | Watson et al. | 29/890.042 |
| 5,221,045 | 6/1993 | McAninch et al. | 29/890.042 X |

FOREIGN PATENT DOCUMENTS

| | | | |
|---|---|---|---|
| 181721 | 9/1954 | Austria | 165/164 |
| 33717 | 9/1924 | Denmark | 165/164 |
| 661853 | 11/1951 | United Kingdom | 165/156 |

*Primary Examiner*—Leonard R. Leo

*Attorney, Agent, or Firm*—Daniel S. Kalka; Robert J. Edwards

[57] ABSTRACT

A reinforced hydraulically expanded flow channel (18) is disclosed which prevents the width of the hydraulically expanded flow channel (18) from changing. This reduces the strain rate in the high strain area next to the welds (16). After the hydraulic expansion process, the ends (20, 22) of the hydraulically expanded flow channel (18) are restrained by a rigid structure (24) such as a tubular member (28). When a tubular member (28) is employed, additional support is provided opposite the desired heat transfer surface (26).

9 Claims, 7 Drawing Sheets

1 denotes inner coil
2 denotes outer coil

REINFORCED HYDRAULICALLY EXPANDED COIL

This is a continuation-in-part of application Ser. No. 07/872,488 filed Apr. 22, 1992 now abandoned.

BACKGROUND OF THE INVENTION

1. Field of the Invention

The present invention relates in general to hydraulically expanded flow channels, and, in particular, to a reinforced hydraulically expanded flow channel which prevents the width of the hydraulically expanded flow channel from changing and as a result reduces the strain rate in the high strain area, and increases the life of the unit.

2. Description of the Related Art

Hydraulic expansion manufacturing techniques are known for creating flow channels. U.S. Pat. No. 4,295,255 issued to Weber describes a method of manufacturing a cooling jacket assembly for a control rod drive mechanism. This technology has been further applied to creating a flow channel as shown in FIG. 1. This type of flow channel has been used as a coiled-tube for a boiler. The flow channel finds utility in many applications, for example, in a stored chemical energy propulsion system (SCEPS) as described in U.S. patent application Ser. No. 07/666,276 filed Mar. 7, 1991, and now U.S. Pat. No. 5,138,765 issued Aug. 18, 1992, hereby incorporated by reference.

To fabricate a flow channel (inner or outer helical coil), one cylinder (12) is placed inside another cylinder (14) and an electron beam welder (not shown) spirally welds in a helical weld path (16) the two cylinders (12, 14) together. After welding, hydraulic pressure is applied between the welds (16) of the two cylinders (12, 14). As the hydraulic pressure increases, the cylinders (12, 14) deform between the helical weld path (16) creating a long, continuous flow channel (18) as shown in FIG. 1.

It is also known to roll two metal sheets into a cylindrical shape to fabricate the cylinders. The cylinders are assembled with a tight mechanical fit radially so that there is no gap, with an interference type fit. As mentioned earlier, the inner cylinder is joined to the outer cylinder by welding through the wall along a helical path, and the end welds are made to close the helical path. More than one helix may be welded to form multiple paths. Next, one of the cylinders is penetrated to the interface and a pressurization line is attached. By pressurizing the interface, the cylinders are expanded apart between the welds to form the flow channel. This may be done hot with gas, or cold with a liquid.

During the expansion, the initial straight-line interface between the cylinders expands into an eye-shape and becomes closer to round as the expansion continues, note FIGS. 2*a–f*. These figures show a finite element model at various stages of the expansion process.

The high strain area is next to the weld (16) in the tight radius bend area. As is apparent from FIGS. 2*b–f*, the strain increases as the expansion process continues. Experimental results for a given geometry, material and test temperature, indicate that failure occurs at approximately the same expansion or strain level independently of the pressure/time cycle.

In manufacture, the part is expanded to a strain level less than the failure strain. The rupture life of the part at a given temperature and pressure depends on the difference between the rupture strain and the expansion strain as manufactured. Rupture life is correlated as follows:

$$LIFE = A \times (1 - LRUPTURE/LEXPANDED)^n$$

where:

LIFE is the rupture life

LRUPTURE is the cylinder length at rupture, and

LEXPANDED is the cylinder length after expansion.

The strain correlates with length or channel width. As the flow channel expands, the width of the channel and the length of the cylinder decrease as the strain increases. These values were A=781,753 and n=2.3674 for a studied case.

In current applications, the expanded coil (10) is used without axial constraint. In service, the flow channel (18) continues to expand based on the operating temperature and pressure until failure occurs.

Thus, it is desirable to prevent the length of the coil from changing and to reduce strain rate in the high strain area next to the weld.

SUMMARY OF THE INVENTION

The present invention solves the aforementioned problems with the prior art as well as others by providing a reinforced hydraulically expanded flow channel having means for restraining both ends of the flow channel to prevent any change in channel width and to reduce the strain rate in the high strain area.

The reinforced hydraulically expanded flow channel in accordance with the present invention comprises at least two metal sheets welded together by a helical weld path. The helical weld path defines a flow channel extending across and along the metal sheets. The flow channel is constructed with hydraulic expansion to provide heat transfer surfaces. Both ends of the flow channel are restrained to prevent any change in the length of the heat transfer surface which reduces strain.

One object of the present invention is to provide a reinforced hydraulically expanded flow channel.

Another object of the present invention is to provide a method for manufacturing a reinforced hydraulically expanded flow channel.

Still another object of the present invention is to provide a hydraulically expanded coil with its ends being restrained to prevent the length from changing and to reduce the strain rate in the high strain area.

A further object of the present invention is to provide a reinforced hydraulically expanded flow channel which is simple in design, rugged in construction, and economical to manufacture.

The various features of novelty characterized in the present invention are pointed out with particularity in the claims annexed to and forming a part of this disclosure. For a better understanding of the invention, and the operating advantages attained by its uses, reference is made to the accompanying drawings and descriptive matter in which a preferred embodiment of the invention is illustrated.

DESCRIPTION OF THE PREFERRED EMBODIMENT

Figure 1:
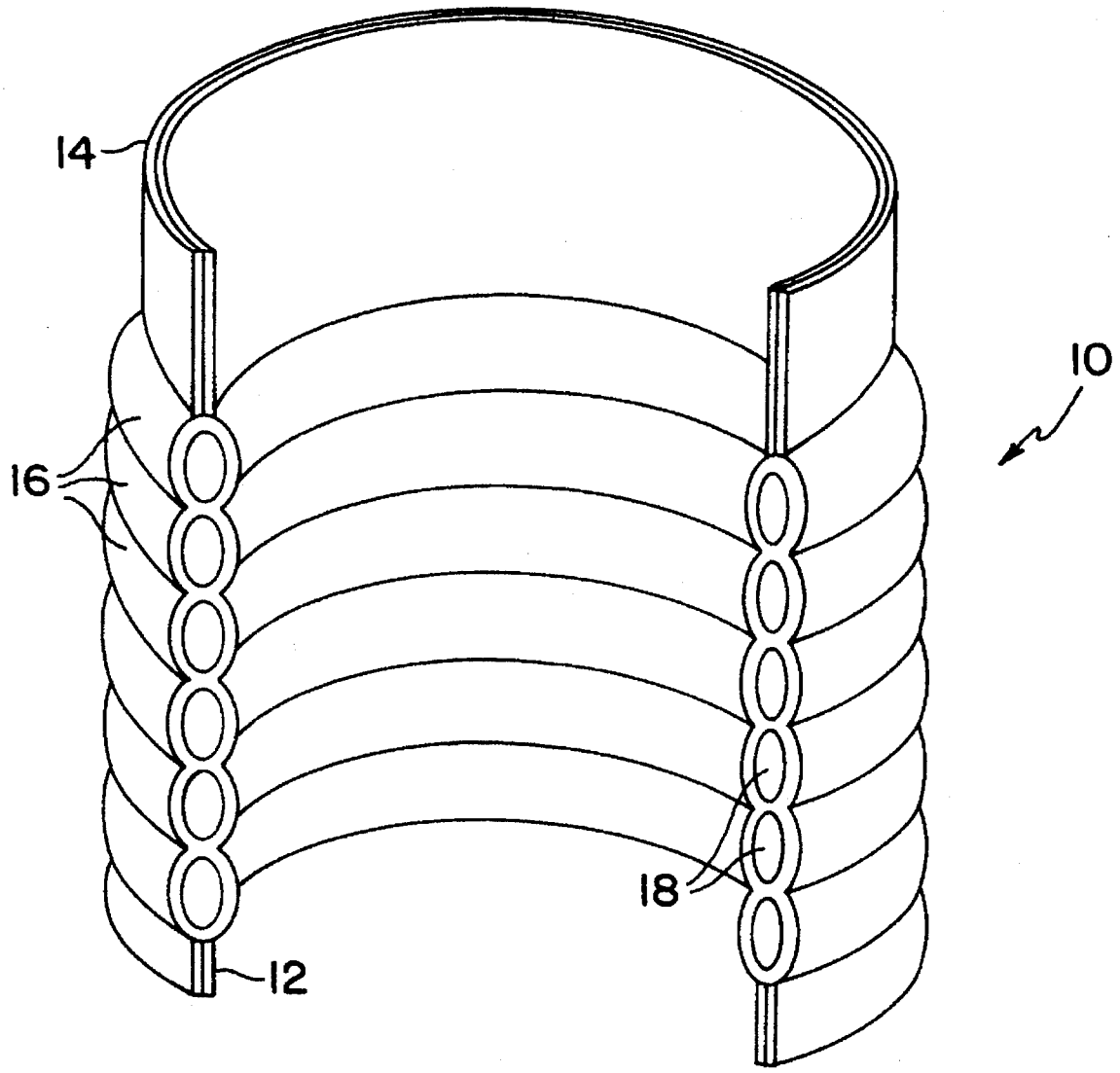
FIG. 1 PRIOR ART
FIG. 1 is a perspective view with a cross-sectional portion removed of a hydraulically expanded flow channel known in the art.
Figure 2A:
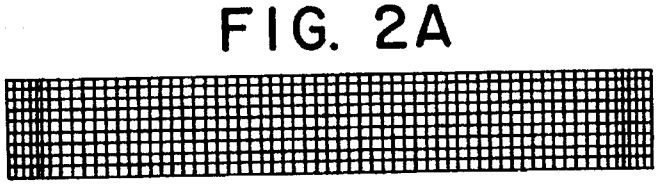
FIGS. 2*a–f* are sectional views of a finite element model at various stages of the expansion process.
Figure 2B:
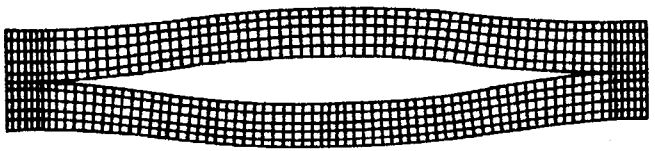
Figure 2C:
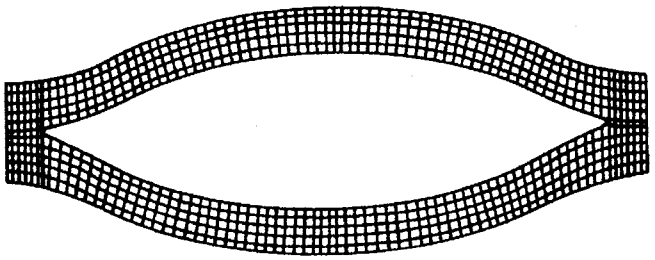
Figure 2D:
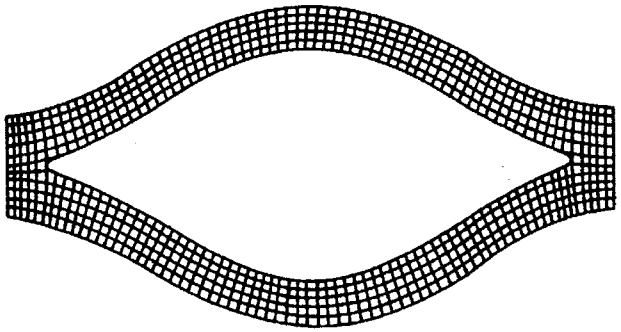
Figure 2E:
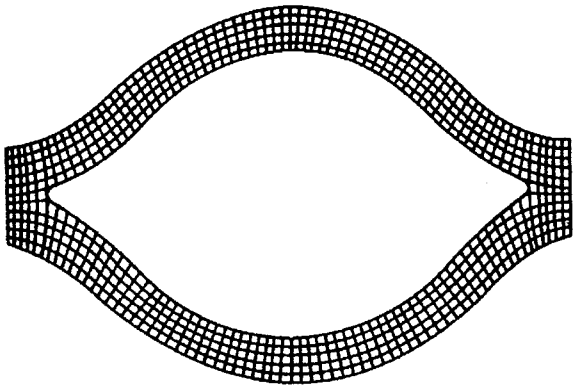
Figure 2F:
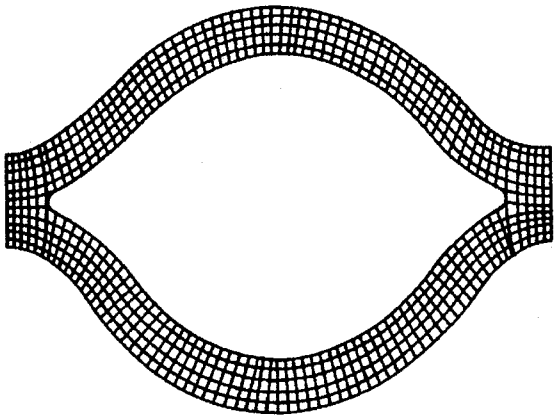

The present invention resides in a reinforced hydraulically expanded flow channel for use as a heat exchanger. A hydraulically expanded flow channel includes a coiled tube boiler (10) as shown in FIG. 1 fabricated with a hydraulic expansion manufacturing technique. In fabricating the coiled tube boiler (10), one cylinder (12) is placed inside a second cylinder (14) so that there is a tight mechanical fit radially. A high speed welding process, such as electron beam welding, welds in a spiral or helical weld path (16) the two cylinders (12, 14) together. After welding, a pressure fitting (not shown) is attached and hydraulic pressure is applied between the welds (16) of the tube cylinders (12, 14). As the hydraulic pressure is slowly increased, the cylinders (12, 14) deform between the helical weld (16) to create a flow channel (18) therebetween. The manufacturing parameters of such hydraulic expansion techniques are taught in U.S. Pat. No. 4,295,255 which is assigned to the present Assignee of the present invention as well as in U.S. patent application Ser. No. 07/666,276 now U.S. Pat. No. 5,138,765 issued Aug. 18, 1992, which is also assigned to the Assignee of the present invention and are hereby incorporated by reference.

Figure 6:
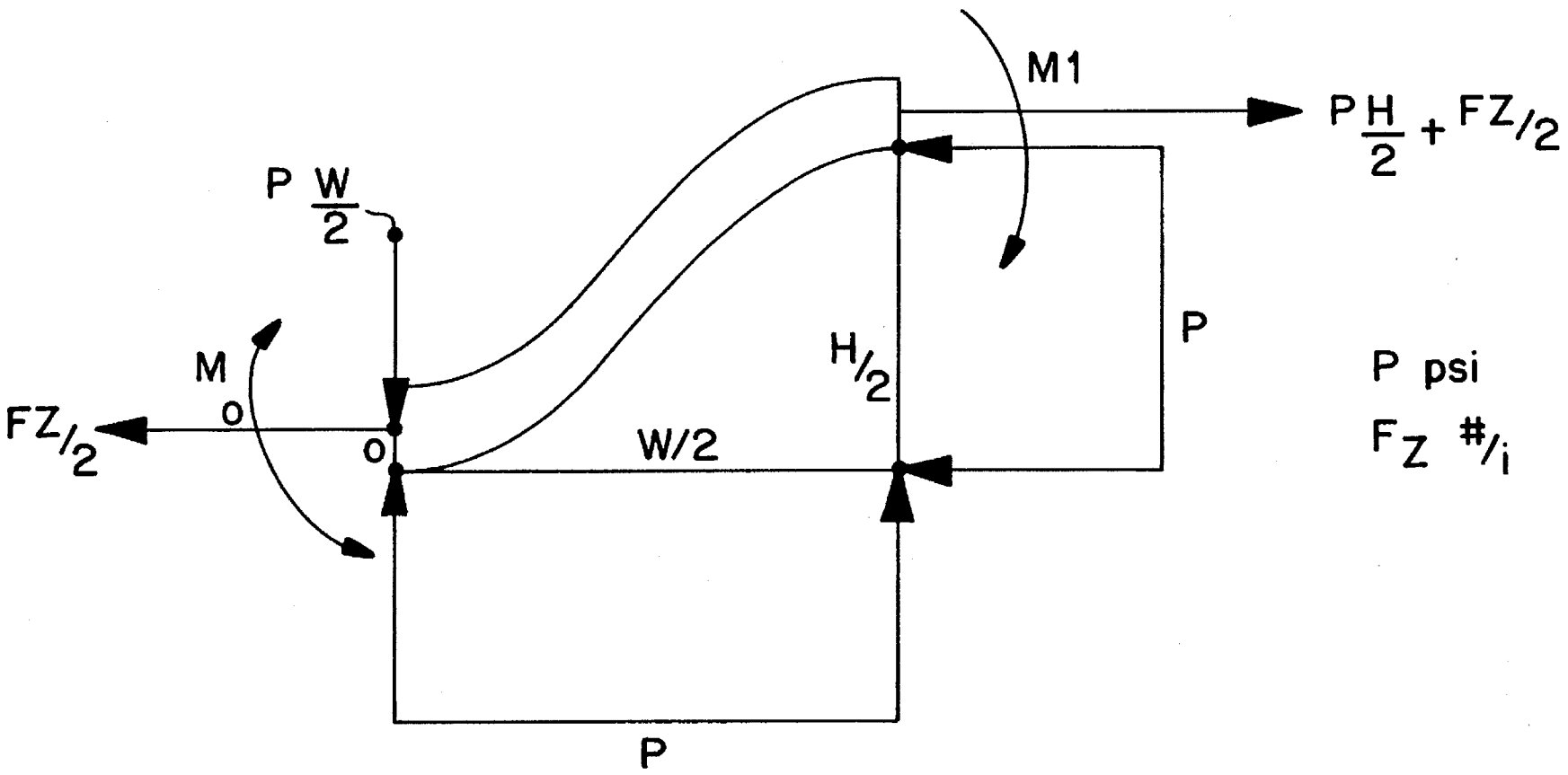
FIG. 6 is a quarter-sectional view of a flow channel as shown in FIG. 2(*f*)

The application of an axial force cancels out the bending moment created by the non-roundness of the section and reduces the strain rate in the high strain area of the bend in operation. For a given hydraulically expanded channel (height and width) and operating pressure, there is a unique axial force that zeroes the bending moment at the high strain area adjacent to the weld as seen in FIG. 6 and the following equations:

where:

$M_0$=bending moment at weld $M_1$=bending moment at peak of flow channel

W=flow channel width

H=flow channel height

P=pressure, psig $F_Z{}^6$=axial force (½ for outer layer and ½ for inner layer), pounds/inch $$\Sigma M = 0$$

-continued $$\widehat{M}_0 + \widehat{M}_1 = P\frac{W}{2}\ \frac{W}{4} + P\frac{H}{2}\ \frac{H}{4} - \left(\frac{PH}{2} + \frac{F_Z}{2}\right)\frac{H}{2}$$

$$\widehat{M}_0 + \widehat{M}_1 = \frac{P}{4}\left[\frac{W^2}{2} + \frac{H^2}{2} - H^2\right] - F_Z H/4$$

$$\widehat{M}_0 + \widehat{M}_1 = \frac{P}{8}\ (W^2 - H^2) - F_Z H/4$$

For $M = 0$ $$F_Z \cdot \frac{H}{4} = \frac{P}{8}\ (W^2 - H^2)$$

$$F_Z = \frac{P}{2}\ \frac{1}{H}\ (W^2 - H^2)$$

$$F_Z = \frac{P}{2}\ \frac{W^2}{H}\ [1 - (H/W)^2]$$

$$F_Z = \frac{PW}{2}\left(\frac{1}{H/W}\right)[1 - (H/W)^2]$$

Figure 3:
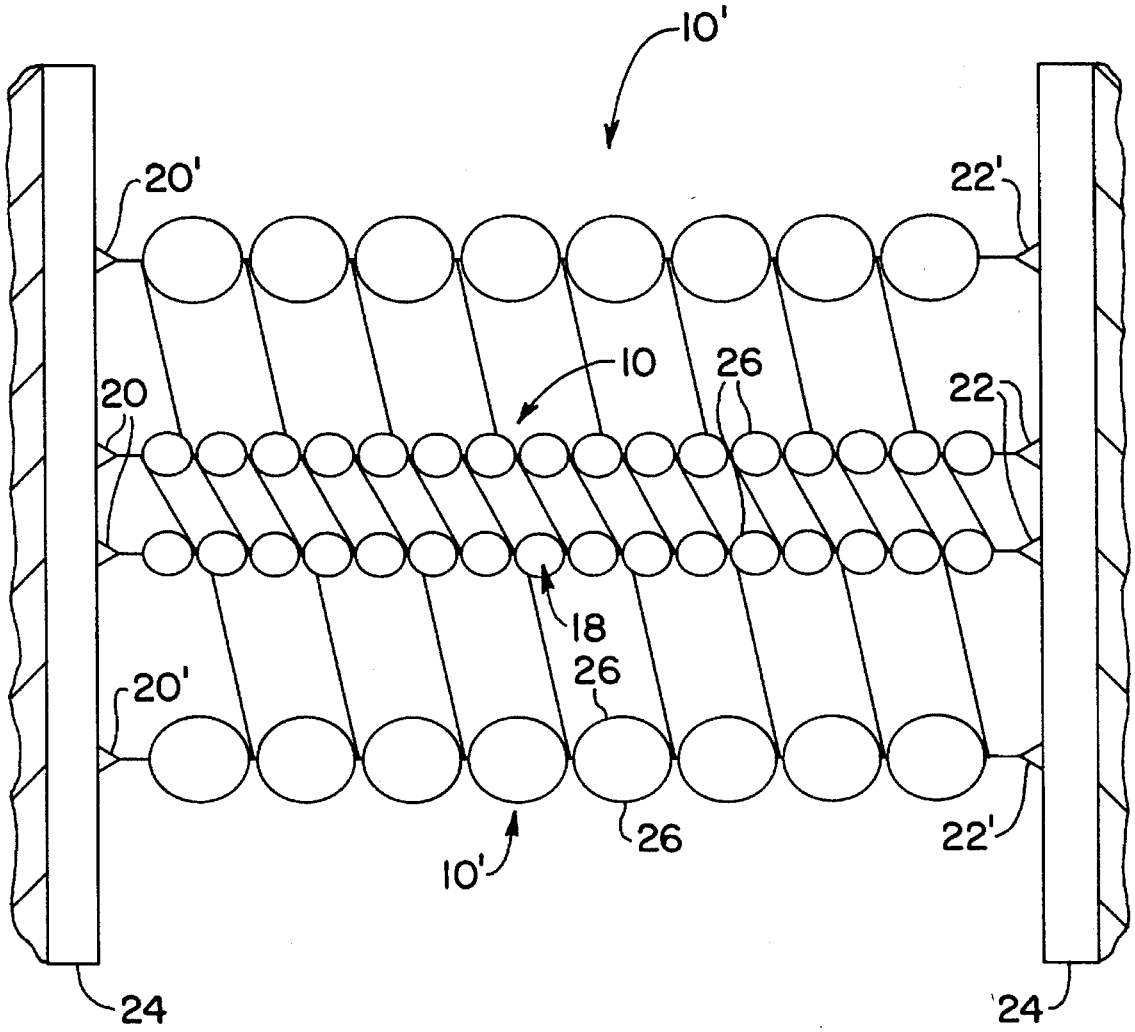
FIG. 3 is a sectional view of an inner and an outer coil or flow channel rigidly attached to a structure in accordance with the present invention.
Figure 4:
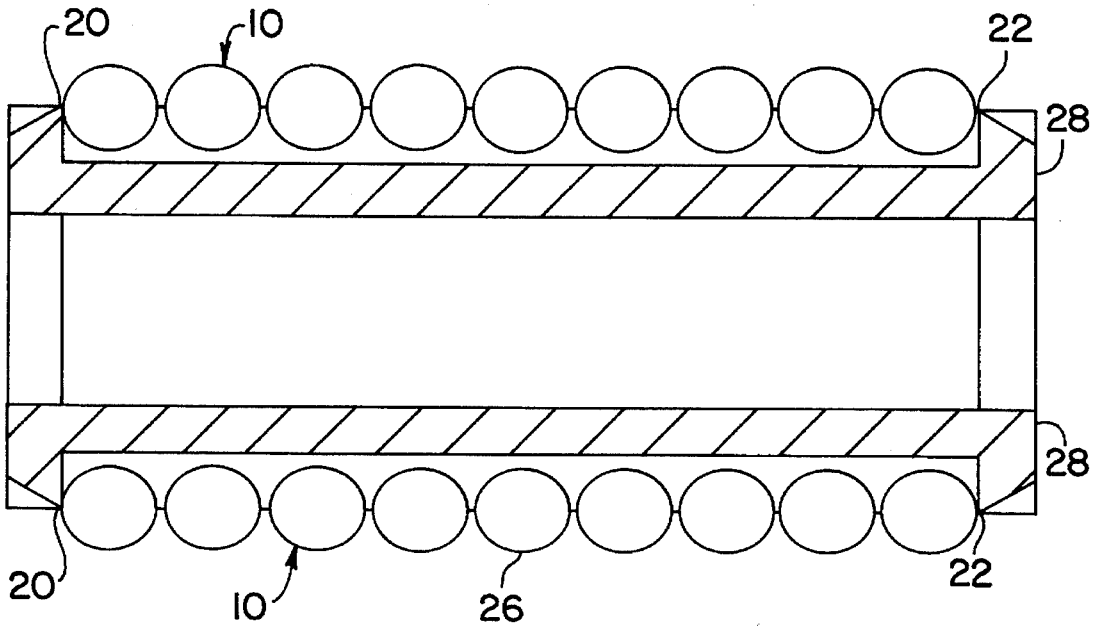
FIG. 4 is a sectional view of a hydraulically expanded flow channel reinforced in accordance with the present invention.
Figure 5:
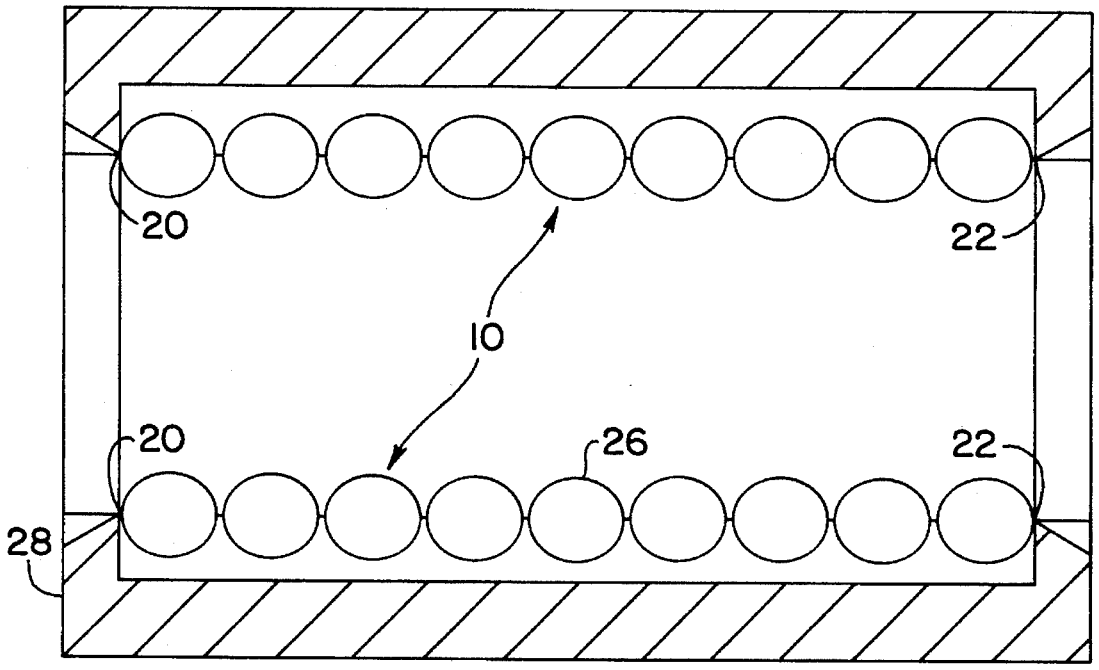
FIG. 5 is a view similar to FIG. 4 of another embodiment of the present invention.

After the expansion process, the ends (20, 22) of the hydraulically expanded coil (10) are restrained such as by welding as shown in FIGS. 3–5. This prevents the length of the coil (10) from changing and reduces the strain rate in the high strain area of the weld (16).

These are various means which may be employed to restrain the ends (20, 22) of the hydraulically expanded coil (10). First, referring to FIG. 3, there is depicted a sectional view of an inner coil (10) and an outer coil (10'). The ends (20', 22') of the outer coil (10') and the ends (20, 22) of the inner coil (10) are rigidly attached for example by welding to an external structure (24). External structure (24) preferably is manufactured from similar material as the coils (10, 10'). However, structure (24) can be made of any material which is sufficiently rigid to hold the coils (10, 10') in place and prevent a change of length therein.

Coils (10', 10) provide heat transfer surfaces (26) which run along the length of the coils both on the inner and outer surfaces to and from the annular space between the coils (10', 10) as best seen in FIG. 3.

In alternate embodiments depicted in FIGS. 4 and 5, the ends (20, 22) of the coil (10) are rigidly attached and also connected by a tubular member (28) on the inside as depicted in FIG. 4, or on the outside of the coil (10) as depicted in FIG. 5. Tubular member (28) also supports the length of the coil (10). The tubular member (28) is situated opposite the desired heat transfer surface (26). For example, for desired heat transfer on the outer diameter of a coil (10), the tubular member (28) is attached and the ends (20, 22) are constrained inside the inner diameter (ID) as shown in FIG. 4. Conversely, for heat transfer across the inside coil surface, tubular member (28) is positioned on the outside of the coil as shown in FIG. 5.

Advantageously, the tubular member (28) restrains the ends (20, 22) to reduce the strain rate in the high strain area around the welds (16). This increases the rupture life of the coil (10). Also, the position of the coil (10) is more stable during operation. Furthermore, the added structure also increases the rigidity of the total assembly when subjected to dynamic loading.

Figure 7:
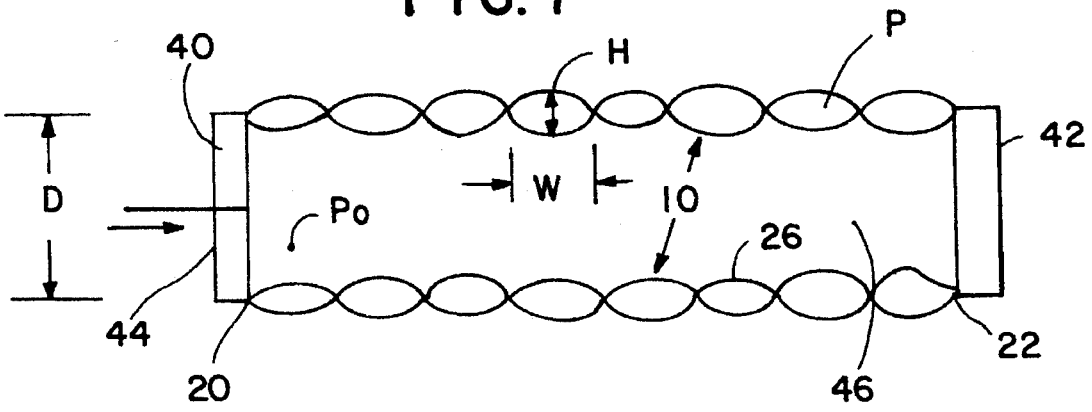
FIG. 7 is a sectional view of a flow channel with closed ends and internal pressure.

Referring to FIG. 7, there is shown a hydraulically expanded coil (10) similar to that shown in FIGS. 1–6. The ends (20,22) of coil (10) are restrained with end caps (40,42). One of the end caps (40) has an opening (44) for pressurizing ($P_o$) the internal cavity (46)in a manner known in the art.

For a given hydraulically expanded coil with coil pressure P, channel width W and channel height H, the net bending moment can be reduced to zero for an internal cavity pressure $P_o$. A higher cavity pressure will tend to stretch the coil and flatten the channels. A lower cavity pressure will allow the channels to continue to expand and the coil length to shorten at a slow rate until failure. A cavity pressure equal to or close to $P_o$ will provide maximum coil life.

Particularly, the application of a predetermined axial force generated by a fluid which may be a gas or liquid depending upon conditions such as application temperature eliminates the bending moment that is created by the non-round flow channel.

For FIG. 7, the calculation of the balanced net axial force to zero the bending moment is as follows:

Balanced net axial force to zero the bending moment.

$$P_o \times \frac{\pi D^2}{4} = \pi D\, FZ = \pi D \frac{P}{2H} (w^2 - H^2)$$

$$P_o = \frac{2P}{HD} (W^2 - H^2)$$

For example:

$D = 3''$; $W = 0.56''$; $H = 0.40''$; $P = 1000$ psi $$P_o = \frac{2(1000)}{(.4)(3)} (.56^2 - .4^2) = 256 \text{ psi}$$

Figure 8:
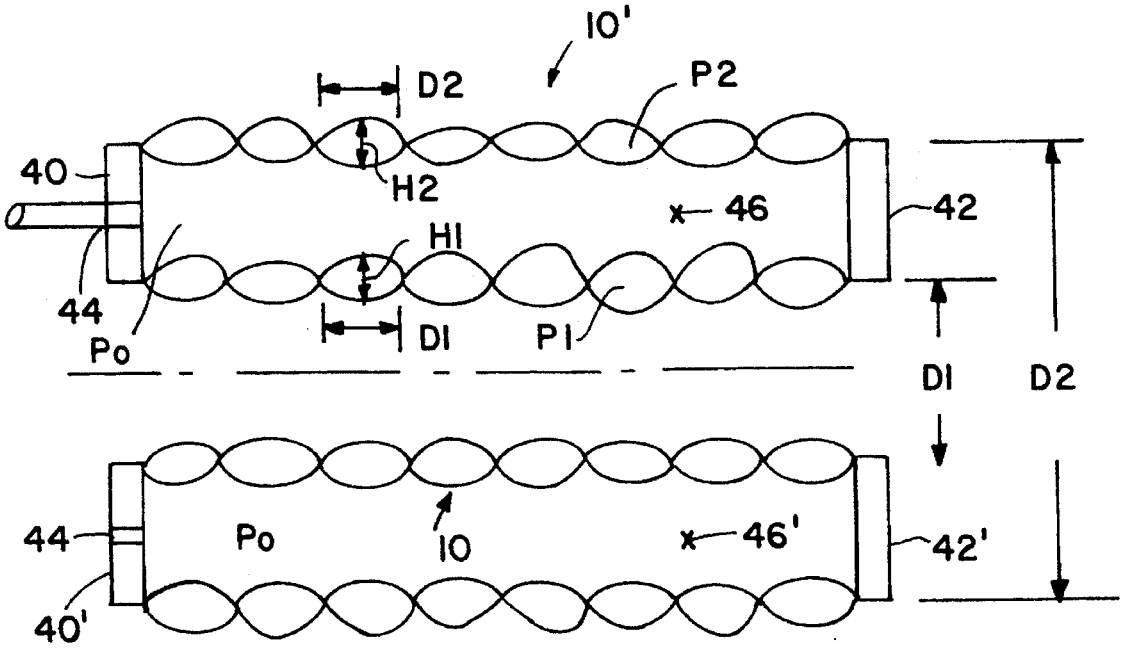
FIG. 8 is a sectional view similar to FIG. 3, with portions omitted showing concentric hydraulically expanded coils with a pressurized internal cavity.

FIG. 8 depicts concentric hydraulically expanded coils with each coil having an internal cavity (46, 46'). The end caps (40,42) and (40', 42') are fastened to the coils (10,10') similar to FIG. 7 for example by welding. An aperture 44 in one end cap (40, 40') allows the internal cavity to be pressurized in a known manner with connectors known in this art to a pressure equal or close to $P_o$ according to the following calculations: Balancing force and pressure to zero the bending moments.

$$P_o \frac{\pi}{4} (D2^2 - D1^2) = \pi D1 \frac{P1}{2H1} (W1^2 - H1^2) + \pi D2 \frac{P2}{2H2} (W2^2 - H2^2)$$

and $$P_o = \frac{\frac{2P1\, D1}{H1} (W1^2 - H1^2) + \frac{2P2\, D2}{H2} (W2^2 - H2^2)}{D2^2 - D1^2}$$

Figure 9:
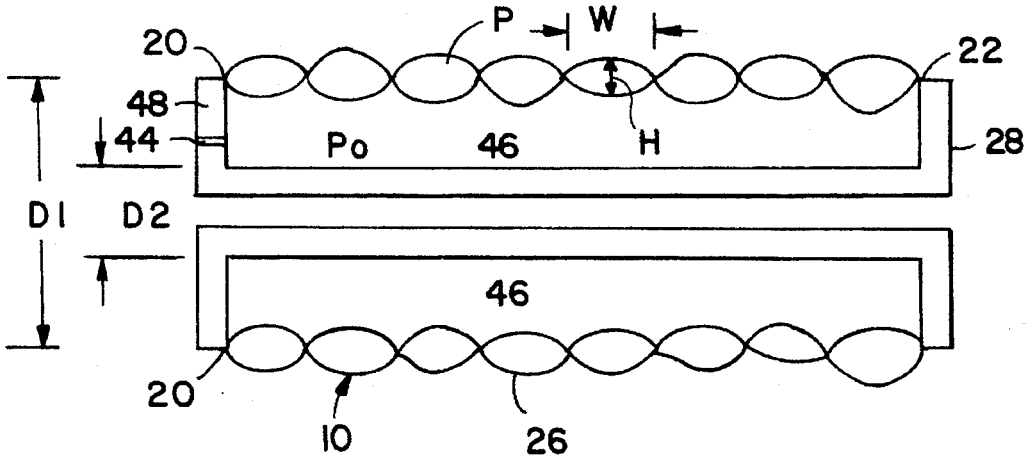
FIG. 9 is a sectional view similar to FIG. 4 with an internal pressurized annulus.
Figure 10:
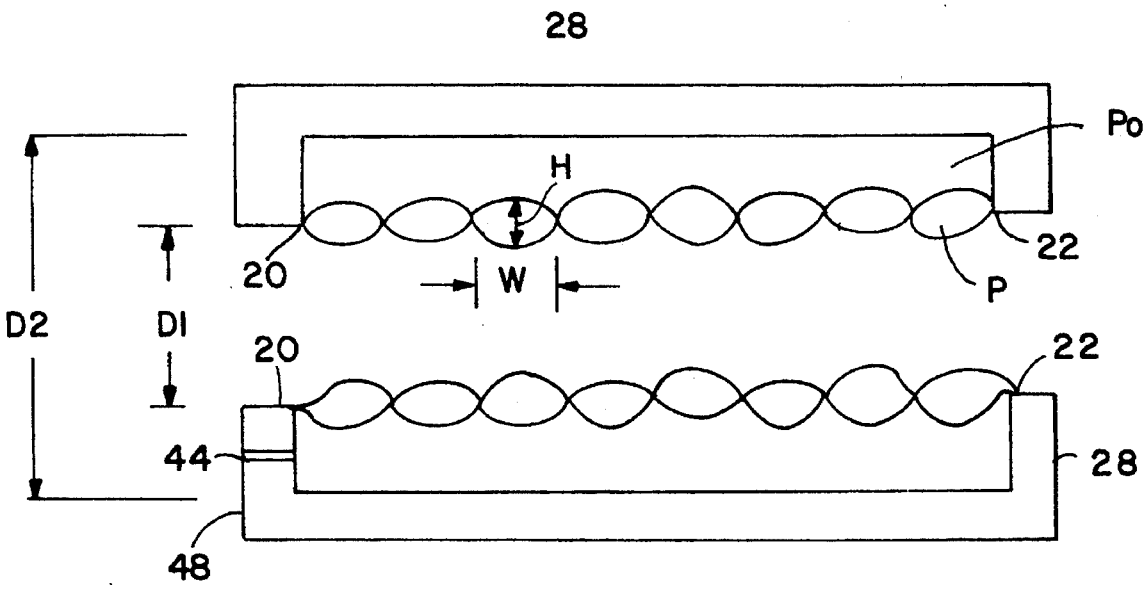
FIG. 10 is a sectional view similar to FIG. 5 with an external pressurized annulus.

FIGS. 9 and 10 are similar to FIGS. 7 and 8 except that tubular member (28) supports the length of the coil and provides the internal cavity (46) by virtue of its structure. One side (48) of the tubular member (28) may be drilled to provide an aperture 44 which is used to pressurize the internal cavity (46).

In FIG. 9, the following calculation is used for $P_o$.

$$P_o \frac{\pi}{4} (D1^2 - D2^2) = \pi D1 \frac{P}{2H} (W^2 - H^2)$$

$$P_o = \frac{2PD1(W^2 - H^2)}{H(D1^2 - D2^2)}$$

(If D2=0, this reduces to FIG. 7.)

In FIG. 10, $P_o$ is calculated as follows:

$$P_o \frac{\pi}{4} (D2^2 - D1^2) = \pi D1 \frac{P}{2H} (W^2 - H^2)$$

-continued $$P_o = \frac{2PD1(W^2 - H^2)}{H(D2^2 - D1^2)}$$

It is understood that other mechanical means could be used to apply the proper axial force.

Suitable alternatives to increase rupture life include using a thicker material for the inner cylinder (12), or a thicker material for the external cylinder (14). Similarly, both cylinders (12, 14) could be made from thicker material for increasing the rupture life. Reinforcement of the coil (10) in the high strain area on the inside, or outside, along the full length of the coil is another method of controlling strain and increasing rupture life.

Tables 1 and 2 represent suitable welding parameters for the given materials for a Union Carbide Electron Beam Welder Model TC30X60.

TABLE 1

Long Seam Butt Weld Electron Beam Weld Parameters

| Material | 316L | IN625 |
|---|---|---|
| Thickness (in.) | .105 | .094 |
| Gun to Work (in.) | 7 | 7 |
| Beam Current (ma) | 30 | 30 |
| Beam Voltage (kv) | 55 | 55 |
| Beam Focus | +3 | 0 |
| (Machine Setting) | Sine | Sine |
| Beam Pattern | | |
| Beam Amplitude | 10 | 10 |
| (Machine Setting) | | |
| Beam Frequency (HZ) | 1000 | 1000 |
| Weld Speed/Gun Speed | 30 | 60 |
| (ipm) | | |

The above parameters are for a stainless steel type 316L and Inconel 625 materials. The spiral welds (16) were formed on a rotating collet of the aforementioned welder as described in U.S. Pat. No. 4,295,255 which is hereby incorporated by reference. The electron beam weld parameters for welding the spiral weld (16) are set forth in Table. 2.

TABLE 2

Electron Beam Welding Parameters-Spiral Weld

| Component Weld Type | Split Beam Partial Penetration | Full Penetration |
|---|---|---|
| Grade Thickness | 316L/0.105 IN625/0.094 | IN625/0.094 |
| Gun to Work (in.) | 7 | 7 |
| Beam Current (ma) | 65 | 70 |
| Beam Voltage (kv) | 55 | 55 |
| Beam Focus | Surface | Surface |
| Beam Type | Split Circle | Circle |
| Beam Amplitude | 45 | 35 |
| (Machine Setting) | 60 (dither) | — |
| Beam Frequency | 4000 | 500 |
| Square Wave (HZ) | 500 | — |
| Weld Speed (ipm) | 45 | 45 |
| Helix Lead (in.) | 1.50 | 1.50 |
| Gun Speed | 1.32 | 1.32 |
| (Machine Setting inpm) | | |
| Work RPM (rpm) | 0.87 | 0.87 |
| (Machine Setting) | | |
| Weld Width (in.) | 0.105 | 0.085 |

While specific embodiments of the invention have been shown and described in detail to illustrate the application and principles of the invention, certain modifications and improvements will occur to those skilled in the art upon reading the foregoing description. Modifications could be made to the present invention for other specific applications in heat exchangers that do not require the coil tube boiler configuration. An example of such modifications is utilization of the present invention in a hydraulically expanded panel wall for heat removal in furnaces, refrigerators, or solar energy collectors.

It is thus understood that all such modifications and improvements have been deleted for the sake of conciseness and readability but are properly in the scope of the following claims.

I claim:

1. A reinforced hydraulically expanded flow channel, comprising:

at least two metal sheets welded together by a helical weld path, said helical weld path defining a flow channel extending across and along the at least two metal sheets and terminating at both ends of the at least two metal sheets, said helical weld path having a plurality of high strain areas next to the weld path, said flow channel being constructed by hydraulic expansion in the form of a coil having inside and outside heat transfer surfaces;

an end cap for both ends of said coil of said flow channel, said end caps defining an internal cavity within said coil, one of said end caps having an opening for pressurizing said internal cavity; and said internal cavity having a cavity pressure of about $P_o$ to eliminate a bending moment created by the non-round flow channel.

2. A reinforced hydraulically expanded flow channel as recited in claim 1, further comprising a fluid pressurized inside said internal cavity to a pressure $P_o$.

3. A reinforced hydraulically expanded flow channel as recited in claim 2, wherein said fluid is pressurized inside said internal cavity to the pressure of $P_o$ where:

$$P_o = \frac{2PD1(W^2 - H^2)}{H(D1^2 - D2^2)}.$$

4. A reinforced hydraulically expanded flow channel as recited in claim 1, wherein $P_o$ is calculated as follows:

$$P_o = \frac{2P}{HD}(W^2 - H^2)$$

5. A reinforced hydraulically expanded flow channel, comprising:

at least two metal sheets welded together by a helical weld path, said helical weld path defining a flow channel extending across and along the at least two metal sheets and terminating at both ends of the at least two metal sheets, said helical weld path having a plurality of high strain areas next to the weld path, said flow channel being constructed by hydraulic expansion;

an external structure connected at both ends of said flow channel and supporting a length of said flow channel, said external structure defining an internal cavity on one side of said flow channel, said external structure having an aperture for pressurizing said internal cavity; and said internal cavity having a cavity pressure of about $P_o$ to eliminate a bending moment created by the non-round flow channel.

6. A reinforced hydraulically expanded flow channel as recited in claim 5, wherein said external structure further includes a tubular member, with said flow channel being rigidly attached on the outside of said tubular member.

7. A reinforced hydraulically expanded flow channel as recited in claim 6, further comprising a fluid pressurized inside said internal cavity formed by said tubular member and flow channel, said pressurized fluid having a pressure of $P_o$ where:

$$P_o = \frac{2PD1(W^2 - H^2)}{H(D2^2 - D1^2)}.$$

8. A reinforced hydraulically expanded flow channel as recited in claim 5, wherein said external structure further includes a tubular member with both ends of said flow channel being rigidly attached on the inside of said tubular member.

9. A reinforced hydraulically expanded flow channel as recited in claim 8, further comprising a fluid pressurized inside said internal cavity formed by said tubular member and said flow channel, said pressurized fluid having a pressure of $P_o$ where:

$$P_o = \frac{2PD1(W^2 - H^2)}{H(D2^2 - D1^2)}.$$

* * * * *